US007717840B2

(12) United States Patent
Li

(10) Patent No.: US 7,717,840 B2
(45) Date of Patent: May 18, 2010

(54) SOFT ROLL MATERIAL-TRANSLATION DEVICE

(76) Inventor: Fagang Li, Room 302, Building 5, No. 5 Xing'anzhi Road, Qingdao Shandong 266003 (CN)

( * ) Notice: Subject to any disclaimer, the term of this patent is extended or adjusted under 35 U.S.C. 154(b) by 158 days.

(21) Appl. No.: 11/886,639

(22) PCT Filed: Mar. 9, 2006

(86) PCT No.: PCT/CN2006/000353

§ 371 (c)(1),
(2), (4) Date: Sep. 18, 2007

(87) PCT Pub. No.: WO2006/097034

PCT Pub. Date: Sep. 21, 2006

(65) Prior Publication Data

US 2009/0029839 A1 Jan. 29, 2009

(30) Foreign Application Priority Data

Mar. 18, 2005 (CN) ..... 2005 1 0054921

(51) Int. Cl.
*B31F 1/00* (2006.01)

(52) U.S. Cl. ..... 493/415; 53/389.3; 53/389.4; 242/522

(58) Field of Classification Search ..... 53/546, 53/389.3, 389.4; 493/415; 242/522, 525, 242/531.1, 542.3, 548
See application file for complete search history.

(56) References Cited

U.S. PATENT DOCUMENTS 2,162,230 A * 6/1939 Salfisberg ..... 53/451
2,989,265 A * 6/1961 Selsted ..... 226/196.1
3,451,187 A * 6/1969 Pitts, Sr. et al. ..... 53/451
3,591,101 A * 7/1971 Gallet et al. ..... 242/415.1
3,606,120 A * 9/1971 Wyatt et al. ..... 226/22
3,682,362 A * 8/1972 Ott, Jr. ..... 226/21
4,085,560 A * 4/1978 McClosky ..... 53/449
4,107,900 A * 8/1978 Izumi ..... 53/555

(Continued)

FOREIGN PATENT DOCUMENTS

CN 2444916 8/2001

(Continued)

OTHER PUBLICATIONS

International Search Rep, Jun. 22, 2006, Guan, Shansong.

*Primary Examiner*—Thanh K Truong
(74) *Attorney, Agent, or Firm*—Buchanan Ingersoll & Rooney PC

(57) ABSTRACT

The present invention relates to a soft roll material-translating device for the mechanical apparatus of machining and cutting after severing. The existing pillow type of automatic packing machine can only pack produces using one single roll of film, so the work efficiency is low. Consequently, the present invention aims at improving the work efficiency and it adopts following technical solutions: the soft roll material-translating device includes a frame (1), a right rotating unit (3) with right folding rod pair (5) and a left rotating unit (2) with left folding rod pair (4) are mounted on the frame (1), the right rotating unit (3) and the left rotating unit (2) can both rotate around a rotating center. By adding a few of mechanisms, the work efficiency of the device can be multiplied one times.

9 Claims, 14 Drawing Sheets

U.S. PATENT DOCUMENTS

| | | | | | |
|---|---|---|---|---|---|
| 4,697,755 | A | * | 10/1987 | Kataoka | 242/534 |
| 5,072,571 | A | * | 12/1991 | Boeckmann | 53/133.4 |
| 5,174,096 | A | * | 12/1992 | Fukuda | 53/551 |
| 5,558,263 | A | * | 9/1996 | Long | 226/114 |
| 5,823,461 | A | | 10/1998 | Hartley et al. | |
| 5,996,491 | A | * | 12/1999 | Kishine et al. | 101/223 |
| 6,233,903 | B1 | * | 5/2001 | Ide | 53/141 |
| 6,264,130 | B1 | | 7/2001 | Hartley, Jr. | |
| 6,705,325 | B1 | * | 3/2004 | Hicks et al. | 131/34 |

FOREIGN PATENT DOCUMENTS

| | | |
|---|---|---|
| CN | 1443700 | 9/2003 |
| CN | 2612611 | 4/2004 |

* cited by examiner

A-A

A-A

SOFT ROLL MATERIAL-TRANSLATION DEVICE

FIELD OF INVENTION

The present invention relates to a soft roll material-translation device for the pillow type automatic packing machine or a mechanical equipment of machining and cutting after severing.

BACKGROUND OF THE PRIOR ART

At the present, the pillow type automatic packing machines (vertical or horizontal) from all over the world are all using one roll of film to package one series of packing goods, so the working efficiency is quite low. In order to improve the packing speed largely and decrease the occupied space, a double track automatic packing machine is developed by combining a couple of pillow type automatic packing machines back-to-back and sharing a common frame in domestic manufacturer. It is a kind of block structure assembled by two automatic packing machines with one common frame. Except the common frame, all other assemblies, such as transmission system, electric system, electron optic tracking system, vertical proper sealing device and end sealing and cutting device are all two independent set of structures, moreover its adjusting, operating and control system are all independent respectively also. During the operation, a couple of rolls of film should be installed on the two machines separately, and the two machines work independently. Though the occupied space is decreased a little, the cost of manufacture and the number of operators is nearly the same as that of the two separate machines.

SUMMARY OF THE INVENTION

The object of the present invention is to solve the technical problems that the existing pillow type automatic packing machine can only pack one series of packing goods using one single roll of film, and the work efficiency is low comparing with the prior art.

To solve the technical problems, the present invention relates to a soft roll material-translation device, which comprises a frame 1. Specially, a left rotating device 2 and a right rotating device 3 that each one of them is turned on the axis of rotating center 6 is set apart on the frame 1, a left folding rod pair 4 is installed on the left rotating device 2, and a right folding rod pair 5 is on the right rotating device 3.

The frame 1 is designed to assemble and support the other part of the device. The left and right turning device 2 and 3 are all positioned on the frame 1 by the connection of rotation pair. The turning center 6 is the rotational axial of left or right turning device 2 or 3 which is run on the axis of turning center 6. Each of left folding rod pair 4 and right folding rod pair 5 comprises a couple of folding arms, and the two folding arms of one folding rod pair should be kept in parallel with one another (in some instances, a certainty included angle should be formed as described below). A couple of roll material (such as plastic film sheet cloth etc.) setting in left and right and being parallel with each other is transited respectively through left folding rod pair 4 and right folding rod pair 5 following the procedure of folding and feeding forward, then the space between the two soft roll material is changed but the two soft roll materials apart from the folding rod pair will be parallel. The left folding rod pair 4 or right folding rod pair 5 is installed direct respectively on the left or right turning device 2 and 3, or they are mounted indirect respectively on the left and right turning device 2 and 3 through the medium of other parts. When the left and right turning device 2 and 3 are turned on the axis turning center 6, the left folding rod pair 4 and right folding rod pair 5 are driven to turn. As a result, the included angle formed by the folding arm and the direction of advance of the soft roll material is adjusted. The changing of the included angle formed by the folding arm and the direction of advance of soft roll material will lead to the change of the space between the two strips of the soft roll material.

The left folding rod pair 4 of the present invention comprises an upper folding arm 4*a* and a down folding arm 4*b*, and the right folding rod pair 5 comprises an upper folding arm 5*a* and a down folding arm 5*b*.

The lower bus bar 4*c* of down folding arm 4*b* and the lower bus bar 5*c* of down folding arm 5*b* go generally through the rotating center 6. First of all, the soft roll material is folded back to the opposite direction to the feeding direction by transiting the down folding arm (the soft roll material goes to the reverse direction from the feeding), then the direction of the soft roll material return to the original feeding direction by transiting and folding through upper folding arm and changing the direction.

If the lower bus bar 4*c* of down folding arm 4*b* and the lower bus bar 5*c* of the down folding arm 5*b* is unparallel, the space of the two film strips of the soft roll material will be changed after they traversing the left folding rod pair 4 and right folding rod pair 5. The interface portion of the soft roll material contacting to any one of upper folding arm 4*a*, down folding arm 4*b*, upper folding arm 5*a* or down folding arm 5*b* is the working surface, so, no matter what shape the cross section of the folding arm is adopted, the bus bar of the working surface should be kept in straight line. If the interior tension of the two strips of soft roll material is relatively uniform (mostly referring to that the tension of two border for one strip of the soft roll material is basic identity), the bus bar of the working surface of upper folding arm 4*a* and down folding arm 4*b* is parallel to each other, and the bus bar of the working surface of upper folding arm 5*a* and down folding arm 5*b* is parallel to each other either. In this way, the forward feeding direction of the strip of soft roll material will be unchanged after two times folding across a couple of arms. If the interior tension of the two strips of soft roll material is uneven (mostly referring to that the tension of two border for one strip of the soft roll material is different in a large extent), a certain degree of included angle should be formed between the bus bar of the working surface of upper folding arm 4*a* and the down folding arm 4*b*, meanwhile, a certain degree of included angle should be formed between the bus bar of the working surface of upper folding arm 5*a* and the down folding arm 5*b*, in this way, the forward feeding direction of the strip of soft roll material will be kept unchanged after two times folding across a couple of arms. The lower bus bar 4*c* of the down folding arm 4*b*, or the lower bus bar 5*c* of the down folding arm 5*b* refers herein to the line where the soft roll material is backfolded to change the direction.

The left or right rotating device 2 or 3 of the present invention comprises a rotating seat 7, a rotating guide unit and a rotating regulating unit respectively. The left folding rod pair 4 or right folding rod pair 5 is installed on the rotating seat 7 of the left or right rotating device 2 or 3 separately.

The rotating seat 7 is connected rotatable with frame 1 by the rotation pair. The rotating guide unit is designed to guide the rotating seat 7 turning on the axis of the rotating center 6 on the frame 1. The rotating regulating unit may be a gear-sector wheel, worm sector-worm pair, turn pair and screw pair etc. The rotating regulating unit is designed to adjust the angular degree which is formed by the rotating seat 7 turning around the rotating center 6. The left folding rod pair 4 is set on the left rotating device 2 directly, or it may be mounted indirectly through other part. The right folding rod pair 5 is installed on the right rotating device 3 directly, or it may be mounted indirectly through the medium of other part.

The rotating guide unit of the present invention comprises a slide block 8 and a rotating slide guide 31 on the frame 1. The rotating regulating unit comprises a sector gear 9 and gear 10. Each sector gear 9 of the left or right rotating device 2 or 3 is fixed to the left or right sides of frame 1 separately, and their centers of circle are all coincided with the rotating center 6. The gear 10 is engaged with sector gear 9, the gear shaft 11 of the gear 10 is set on the rotating seat 7, and a rotary knob 12 is positioned on the gear shaft 11. The slide block 8 is mounted on the rotating seat 7, and it is fitted with the rotating slide guide 31 on the frame 1. The virtual centre of a circle of the rotating slide guide 31 is coincided with the rotating center 6.

The rotary knob 12 may be replaced by handgrip or other structure having the similar function. When turning the rotary knob 12, the gear shaft 11 is rotated to drive gear 10 rolling upon sector gear 9. When gear 10 rolls along the sector gear 9, the rotating seat 7 and slide block 8 which is cooperated with the rotating slide guide 31 on frame 1 and driven by the gear shaft 11 is turned around rotating center 6.

The rotating regulating unit of the present invention further comprises screw stem 14 and knob 15. The screw stem 14 is cooperated with bolt hole in the slide block 8 with one end of screw stem 14 contacted with frame 1 and another end connected with knob 15. The screw stem 14 and knob 15 are used for loosing (Yr locking the rotating seat 7 from or with the frame 1, and knob 15 may be a handgrip or other institution for performing the similar function. As the slide block 8 is mounted on the rotating seat 7, the rotating seat 7 is loosen or locked through lockout or lock of slide block 8. In the present invention, the screw stem 14 and knob 15 may also be positioned on the rotating seat 7, so the rotating seat 7 is loosen or locked directly by turning the screw stem 14 and knob 15. The technical solution that the screw stem 14 and knob 15 installed on the rotating seat 7 is in the protection field of the present invention. Any other technical solution for loosing and locking supplied for the substitution of the screw stem 14 and knob 15 may also be taken. As long as the substitutional device may loose the rotating seat 7 from frame 1 or fix the rotating seat 7 with the frame 1, it should be in the protection field of the present invention.

The rotating guide unit and rotating regulating unit of present invention is described as followed: The rotating guide unit comprises a pin roll 16 on frame 1, and an axle hole on the rotating seat 7 of the left and right rotating device 2 and 3 is installed in pin roll 16 through the corresponding axle hole. Moreover, the axis of pin roll 16 is coherent with the axis of rotating center 6 of the left and right rotating device 2 and 3. The rotating regulating unit comprises an arc channel 17, a pin roll 18, an adjusting shaft 19, a screw stem 20, a screw stem 21 and a pin roll 22. The arc channel 17 is located on the frame 1, its centre matches together with the rotating center 6. The middle part of pin roll 18 is situated in the arc channel 17. One end of pin roll 18 is fasten on the rotating seat 7, and another end is connected with the screw stem 21. One end of pin roll 22 is fixed on the frame 1, and the other end is connected with the screw stem 20. Both the two ends of the adjusting shaft 19 have the female thread with adverse rotary direction, and the screw stem 20 and 21 with the adverse rotary direction combines with the female thread in the two ends of adjusting shaft 19.

The pin roll 18 takes the movement of arcs of circles along the arc channel 17 to drive the rotating seat 7 turning all along the rotating center 6. When turning the adjusting shaft 19, the screw stem 20 and 21 flex along the adjusting shaft 19 in reverse direction, thereby, the rotating seat 7 which is driven by pin roll 18 moves around rotating center 6. The self-locking action between one female thread in the two ends of adjusting shaft 19 and one of the screw stem 20 and 21 is provided, so the rotating seat 7 is locked up upon frame 1.

At least one of the first and second upper folding arms 4*a* and 5*a* is installed on the motional seat 23 which is mounted on the turning seat 7. A motional guide unit and a motional regulating unit are equipped on the motional seat 23.

The upper folding arm 4*a* or upper folding arm 5*a* may be mounted directly upon motional seat 23, or it may be installed indirectly through the medium of other device. The motional seat 23 and rotating seat 7 is connected by motional pair, motional seat 23 may shift on the rotating seat 7. The parallel translation of upper folding arm 4*a* over the down folding arm 4*b*, or upper folding arm 5*a* down folding arm 5*b* is driven by motional seat 23. The motional seat 23 which takes the straight line motion along the rotating seat 7 is guided by the motional guide unit in order to change the space between the upper folding rod 4*a* and down folding arm 4*b*, or the space between the upper folding arm 5*a* and down folding arm 5*b*. The moving space of adjusting motional seat 23 along rotating seat 7 is controlled by the motional regulating unit, namely, the space between adjust folding arm 4*a* and down folding arm 4*b*, or the space between upper folding arm 5*a* and down folding arm 5*b*.

The upper folding arm 4*a* and 5*a* of the present invention is installed on the rotating seat 7 or motional seat 23 respectively through the corresponding swing pin roll 24, and the upper folding arm 4*a* and 5*a* are all equipped with swing regulating units.

The upper folding arm 4*a* or upper folding arm 5*a* is mounted directly upon the motional seat 23, or it may be installed indirectly through the medium of other device. The motional seat 23 and rotating seat 7 is connected by motional pair (prism pair), motional seat 23 may shift on the rotating seat 7. The parallel translation of upper folding arm 4*a* over the lower folding arm 4*b*, or upper folding arm 5*a* over the lower folding arm 5*b* is driven by the motional seat 23. The motional seat 23 which takes the straight line motion along the rotating seat 7 is guided by the motional guide unit in order to change the space between the upper folding rod 4*a* and lower folding arm 4*b*, or the space between the upper folding arm 5*a* and lower folding arm 5*b*. The motional regulating unit is provided for adjusting the moving space of the motional seat 23 along rotating seat 7, namely, adjusting the space between upper folding arm 4*a* and lower folding arm 4*b*, or the space between upper folding arm 5*a* and lower folding arm 5*b*.

The upper folding arm 4*a* or 5*a* of the present invention is installed on the rotating seat 7 or motional seat 23 respectively through the corresponding swing axis pin 24, and the upper folding arm 4*a* and 5*a* are all equipped with swing regulating units.

The upper folding arm 4*a* or 5*a* of the present invention is installed either on the rotating seat 7 or on the motional seat 23 respectively through the corresponding swing pin roll 24, and at least one of a swing pin roll shaft 24 is positioned on the motional seat 23. The included angle between upper folding arm 4*a* and down folding arm 4*b*, or the included angle formed by upper folding arm 5*a* and down folding arm 5*b* may alter by turning the upper folding arm 4*a* or 5*a* around the corresponding swing pin roll 24. The tension of each border of each film strip of the soft roll material can be governed by adjusting the included angle formed by upper folding arm 4*a* and down folding arm 4*b*, or the included angle formed by upper folding arm 5*a* and down folding arm 5*b*. The rotating regulating unit may be a slide block, screw pair, column pair and screw pair, eccentric wheel or clutch etc. The angular degree of pendular movement of upper folding arm 4*a* or upper folding arm 5*a* is regulated by the rotating regulating unit which also fixes the upper folding arm 4*a* and upper folding arm 5*a* at this angular degree.

A drive roll 25, a tool carrier 27 are placed on the frame 1, and a cutting knife 26 is carried by the tool carrier 27. The drive roll 25 stands in front of the upper folding arm 4*a* and 5*a*. The cutting knife 26 is situated in the middle of drive roll 25.

The drive roll 25 is provided for driving the soft roll material which moves forward and fed to the folding rod pair 4 and 5. When the present invention is applied for packing machine or related equipment, the film drive roll of the packing machine may substitutes the drive roll 25. The extended line of the cutting knife which cut the soft roll material along the longitudinal direction into two film strip goes through the middle of folding pair 4 and 5.

A guide roll 28 is provided on the frame 1 of the present invention, and it is situated at the backside of the down folding arm 4*b* and 5*b*.

The guide roll 28 is provided for guiding the two cut film strip of soft roll material which is folded and drawn apart with a space from each other by the folding rod. When the device of the present invention is provided for a packing machine, frame 1 swings and modulates around drive roll 25, and the guide roll 28 translate parallel along the surface of frame 1 simultaneity, thus the bag making compact adjusting roller for the packing machine may be replaced by the guide roll 28.

The present invention is mainly applied in (vertical or horizontal) pillow type automatic packing machine or other mechanical apparatus for re-machining and cutting after cutting and severing. By adding a few devices, the work efficiency may improve for one times comparing with the prior art. For example: while a set of the device of the present invention, a side by side supply and transportation device for supplying the packaged goods, a bag making device, and a vertical sealing device are equipment with the original package machine, and the portion relating to the width of the film is widened, a two series automatic packaging for goods in one automatic packing machine can be accomplished by using one set of transmission electric appliance, electron optic tracking system, and operating and controlling device. The packing efficiency can be improved duplication without increasing the number of operating staff.

DETAILED DESCRIPTION OF THE PREFERRED EMBODIMENTS

The present invention shall be described in details by the preferred embodiments with reference to the drawings.

Embodiment 1

Figure 1:
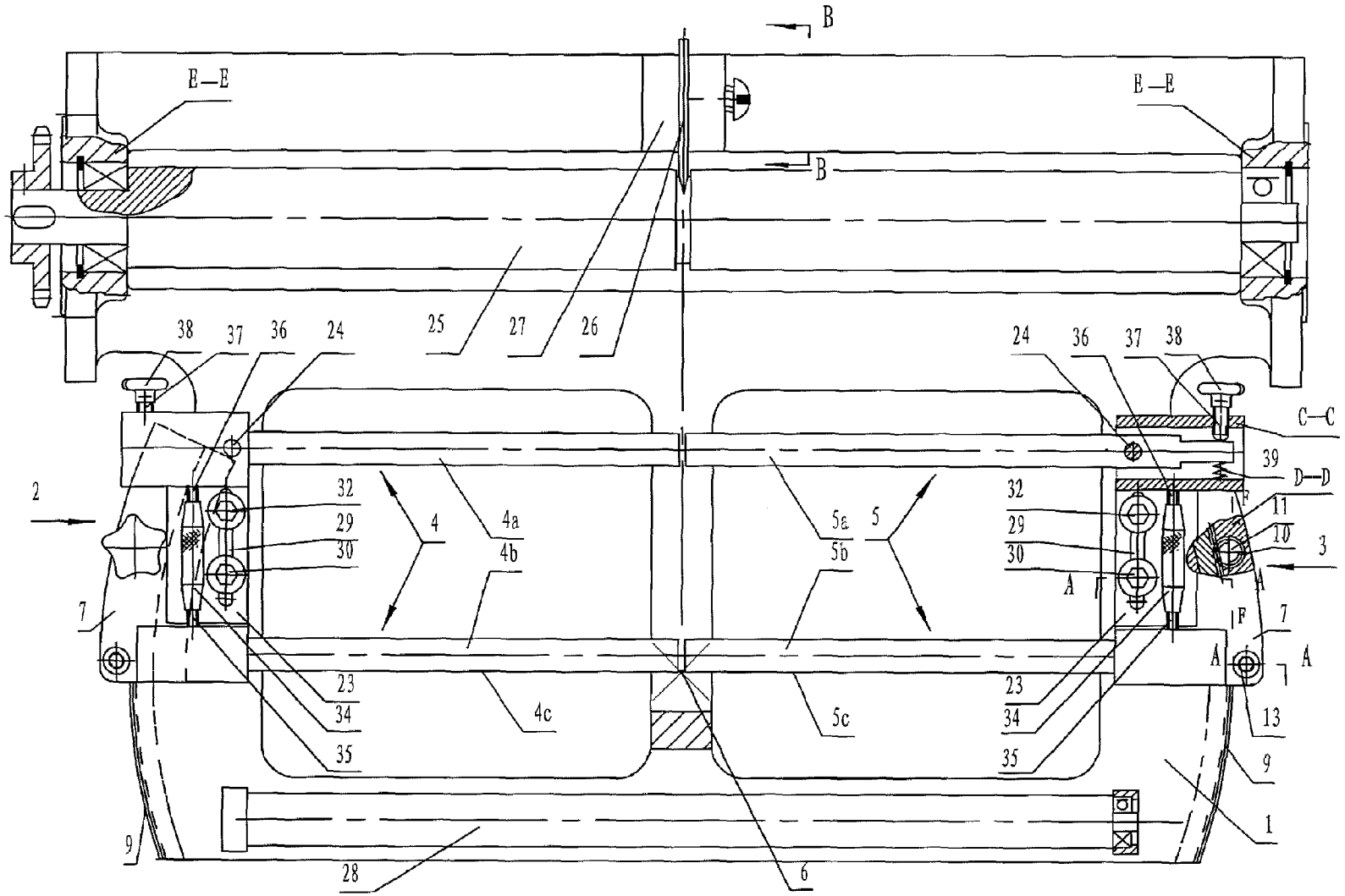
FIG. 1 is a principal view for the embodiment 1 of the present invention (including the sectional view of C-C, D-D and E-E)
Figure 2:
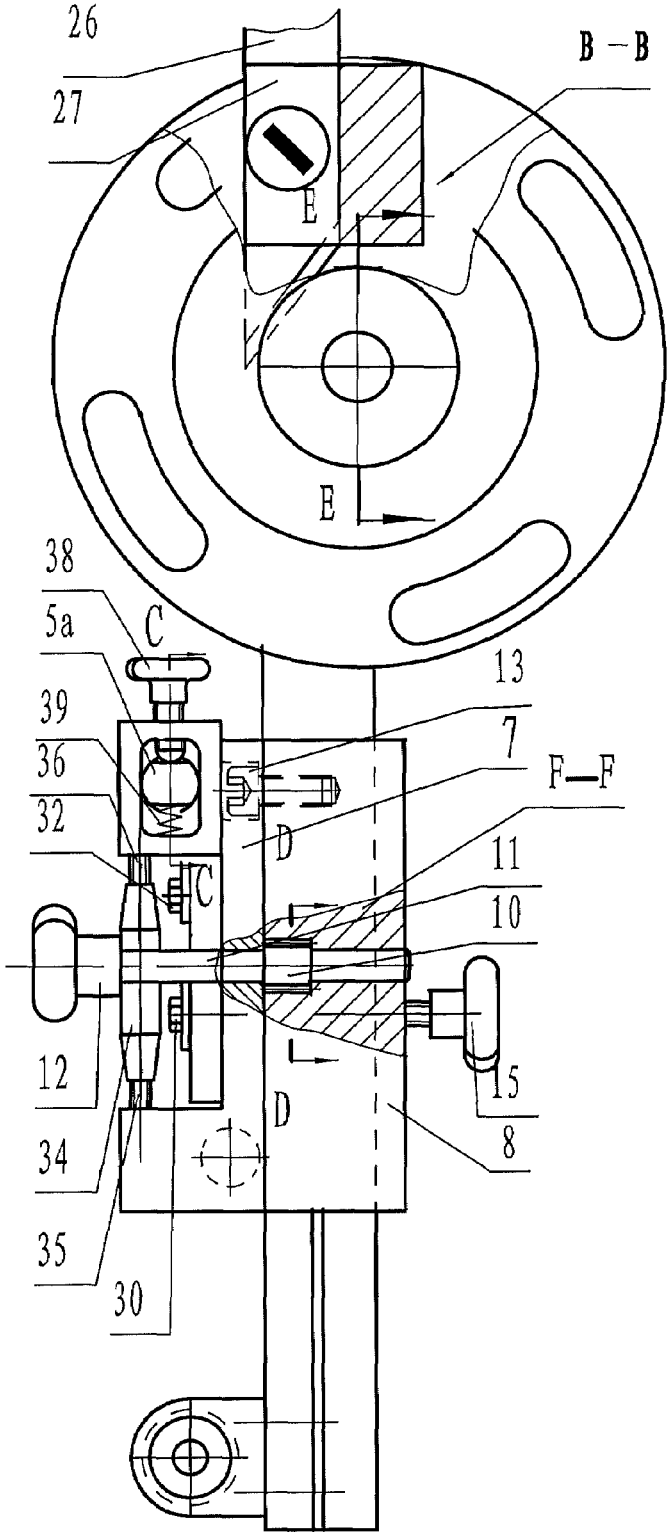
FIG. 2 is a right side view for the embodiment 1 of the present invention (including the sectional view of B-B, F-F of FIG. 1)
Figure 3:
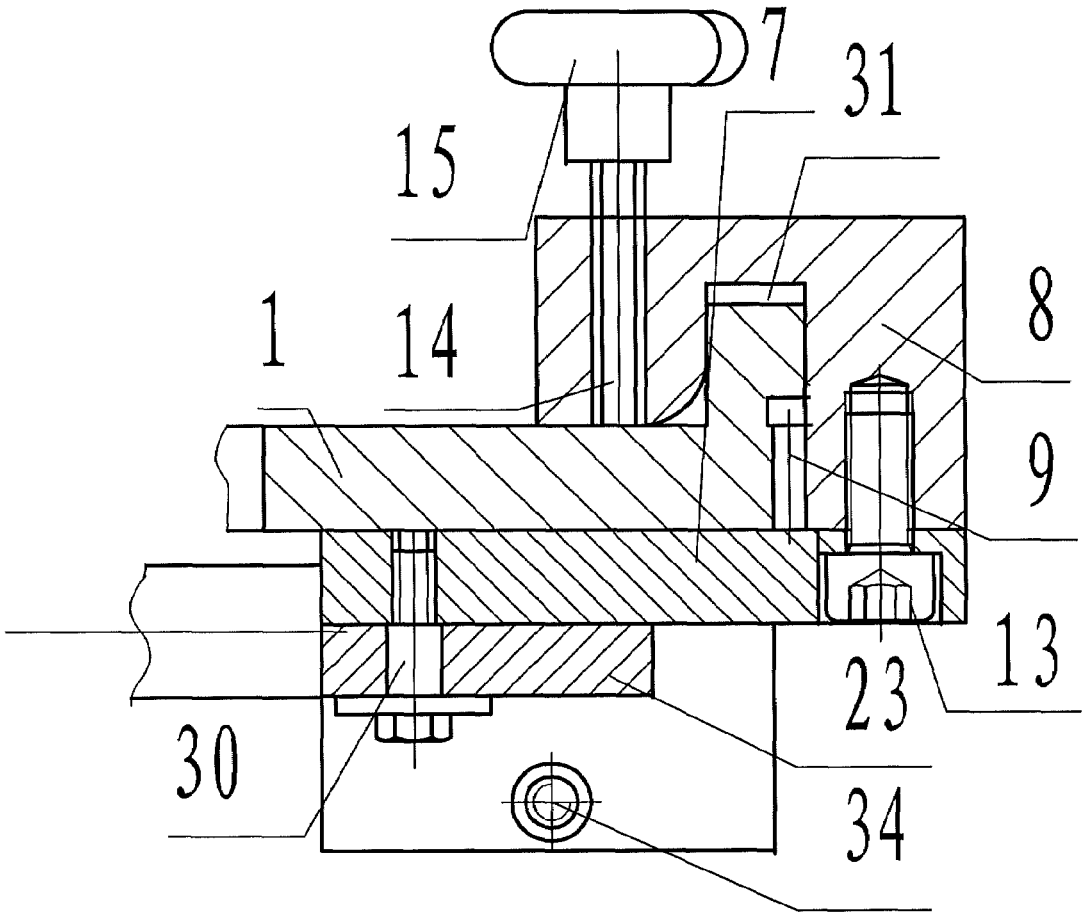
FIG. 3 is the A-A sectional view of FIG. 1.

As shown in FIGS. 1 to 3, the embodiment 1 is a soft roll material-translation device for a pillow type automatic packing machine, which comprises a frame 1, a left rotating device 2, a right rotating device 3, a left folding rod pair 4 and a right folding rod pair 5. The left rotating device 2 and right rotating device 3 are attached respectively to the left and right sides of the frame 1 symmetrically, and the two rotating devices turn on an axis of the rotating center 6 of the frame 1 respectively. The left folding rod pair 4 is attached to the left rotating device 2, and the right folding rod pair 5 is positioned on the right rotating device 3. Each of the left and right rotating devices 2 and 3 comprise a rotating seat 7, a rotating guide unit and a rotating regulating unit. The left folding rod pair 4 and right folding rod pair 5 are installed on the corresponding left and right rotating device2 and 3 of the rotating seat 7 separately. The left folding rod pair 4 comprises an upper folding arm 4*a* and a down folding arm 4*b*, and the right folding rod pair 5 comprises an upper folding arm 5*a* and a down folding arm 5*b*. The working surface of the upper folding arm 4*a*, down folding arm 4*b*, upper folding arm 5*a* and down folding arm 5*b* are all circular rods. The rotating guide unit is a slide block 8 and a rotating slide guide 31 on the frame 1. The rotating regulating unit comprises a sector gear 9 and a gear 10. The rotating slide guide 31 is fixed on the sector gear 9. Each sector gear 9 of left and right rotating devices 2 and 3 is fixed to the left and right sides of frame1 separately, and their centers of the circle coincide with that of the rotating center 6. The gear 10 is engaged to sector gear 9, the gear shaft 11 of the gear 10 is set on the rotating seat 7, and a rotary knob 12 is mounted on the gear shaft 11. The slide block 8 with a hollow slide guide 31 is fixed on the rotating seat 7 through the external screw 13, and the hollow rotating slide guide 31 of the slide block 8 is cooperated with the protrusive rotating slide guide 31. The centre of the rotating slide guide 31 and sector gear 9 matches together with the rotating center 6. The rotating regulating unit further comprises a screw stem14 and knob 15. The screw stem14 is cooperated with bolt hole in the slide block 8, one end of screw stem 14 contacts with sector gear 9 and another end is connected with knob 15. The upper folding arm 4*a* or 5*a* is set respectively on the left or right motional seat 23 which located on the left or right rotating seat 7 separately. The down folding arm 4*c* or down folding arm 5*b* is mounted respective directly on the left or right rotating seat 7 in the way that the down bus bar 4*c* of the down folding arm 4*b* and the down bus bar 5*c* of down folding arm 5*b* pass through the rotating center 6. A motional guide unit and a motional regulating unit are equipped on the motional seat 23. The motional guide unit comprises a guide channel 29, screw 30 and 32. The guide channel 29 with a straight groove vertical to the corresponding down folding arm 4*b* or 5*b* is mounted on the motional seat 23. The link connecting the external screw 30 and 32 is vertical to the axial of down folding arm 4*b* or 5*b*. The motional seat 23 is positioned on the rotating seat 7 by passing the external screw 30 and 32 through the guide channel 29 and fitting the screw 30 and 32 with the screw hole in the rotating seat 7 respectively, so the motion seat 23 motions straightaway along the two external screw 30 and 32 through guide channel 29. The motional regulating unit comprises a regulating shaft 34 and, a screw stem 35, and a screw stem36. Both the two ends of the regulating shaft 34 have the female thread with adverse rotary direction, and the screws 35 and 36 with the adverse rotary direction combines with the female thread in the two ends of regulating shaft 34 separately. The screw 35 and 36 is mounted on the rotating seat 7 and motional seats 23 respectively, and the axial of regulating shaft 34, screw 35 and 36 is vertical to the axial of down folding arm 4*b* or 5*b*. The upper folding arm 4*a* or 5*a* is installed respectively on the motional seat 23 through the corresponding swing pin roll 24, and both the upper folding arm 4*a* and 5*a* are equipped with swing regulating units. The swing regulating unit comprises an external screw 37, a rotational controller 38 and a sprung 39. The external screw 37 is fitted into the screw hole of the motional seat 23, one end of the external screw 37 is contacted with the corresponding side of the end of the down folding arm 4*b* or 5*b*, and another end is assembled with rotational controller 38. The sprung 39 is a compression spring. One of its ends gets in touch with the motional seat 23, and the other end meets one side of the end of the down folding arm 4*b* or 5*b*. A drive roll 25, a tool carrier 27 are placed on the frame 1, and a cutting knife 26 is mounted on the tool carrier 27. The drive roll 25 which is substituted by the drive roll of the film for packing machine stands in front of upper folding arm 4*a* and 5*a*. The cutting knife 26 stands in the middle of drive roll 25. A guide roll 28 is provided on the frame 1, and it is situated at the backside of the down folding arm 4*b* and 5*b*.

Embodiment 2

Figure 4:
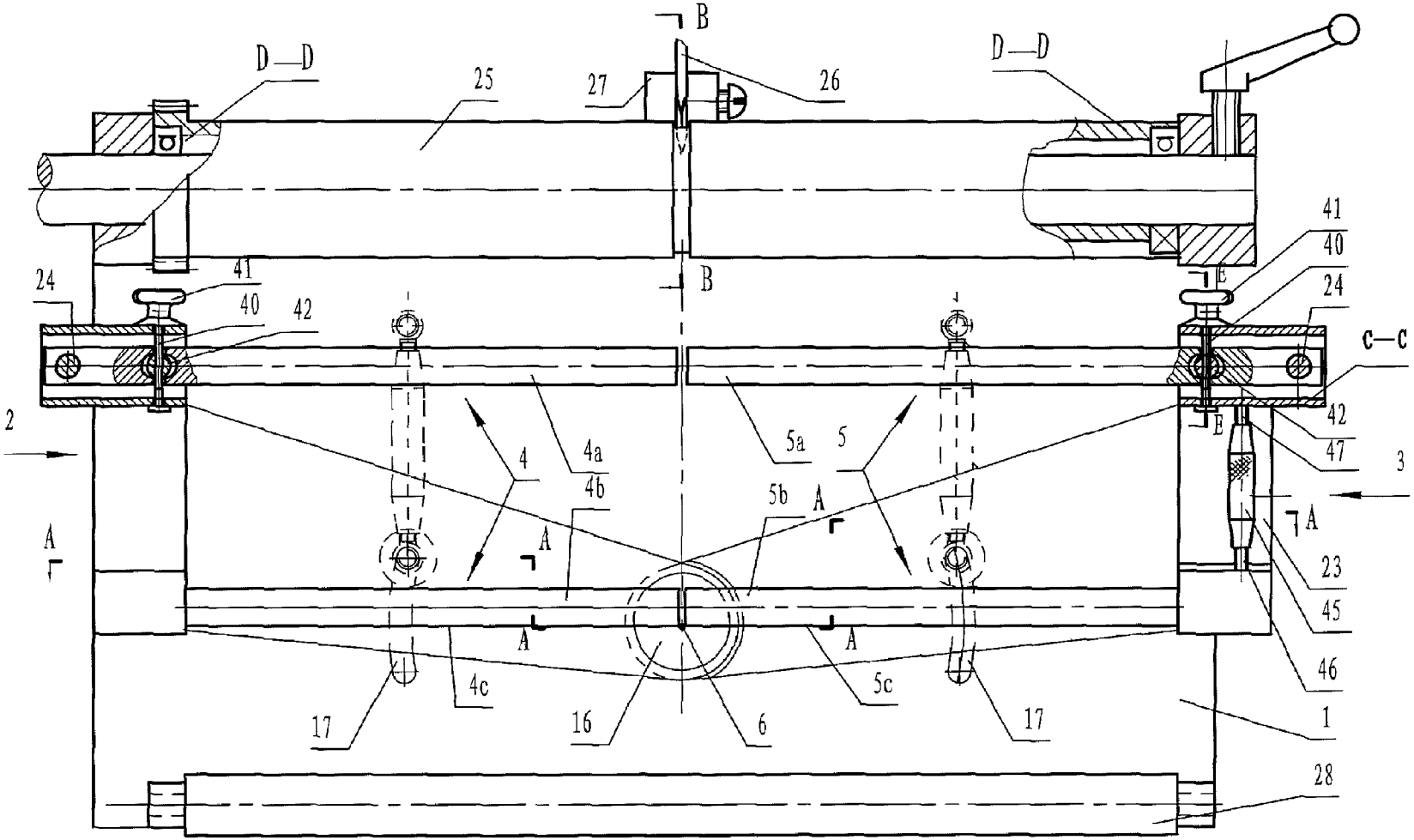
FIG. 4 is the principal view for the embodiment 2 of the present invention (including C-C and D-D sectional view of FIG. 5)
Figure 5:
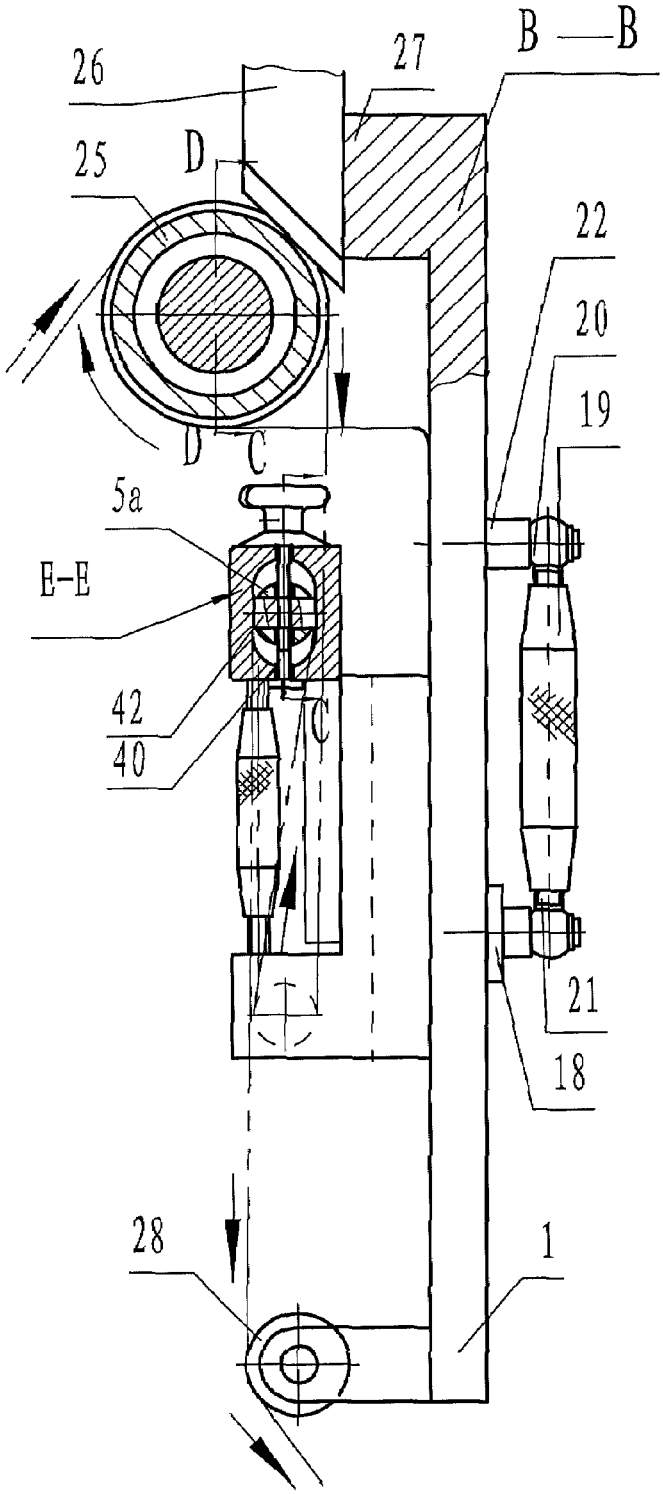
FIG. 5 is a right side view for the embodiment 2 of the present invention (including B-B and E-E sectional view of FIG. 4)
Figure 6:
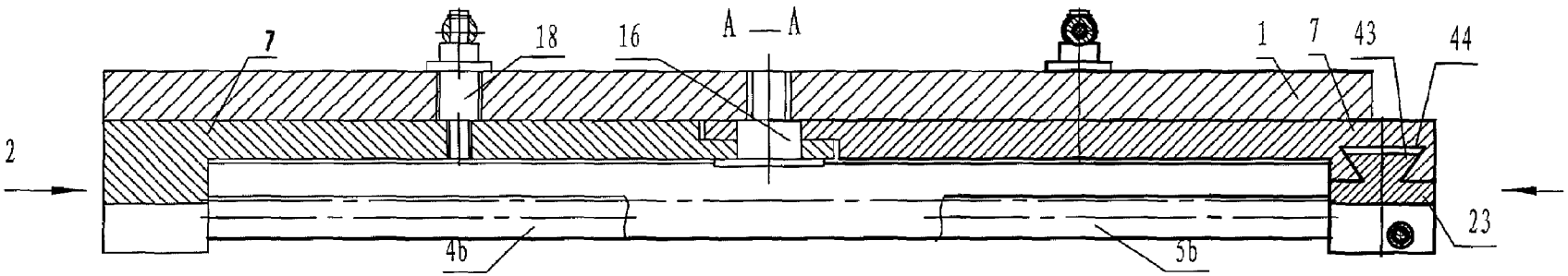
FIG. 6 is the A-A sectional view of FIG. 4.
Figure 7:
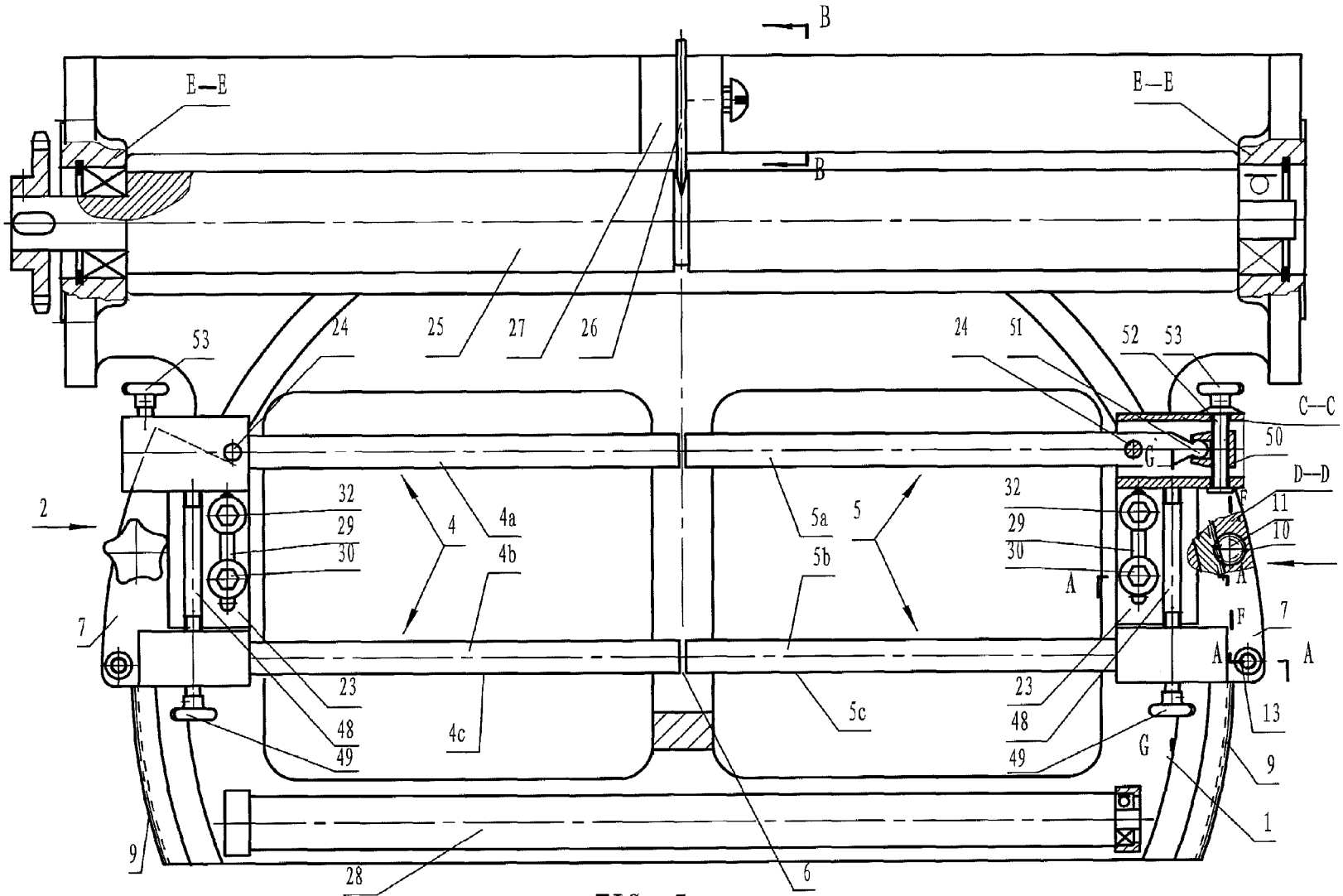
FIG. 7 is the principal view for the embodiment 3 of the present invention (including C-C, D-D and E-E sectional view of FIG. 8)
Figure 8:
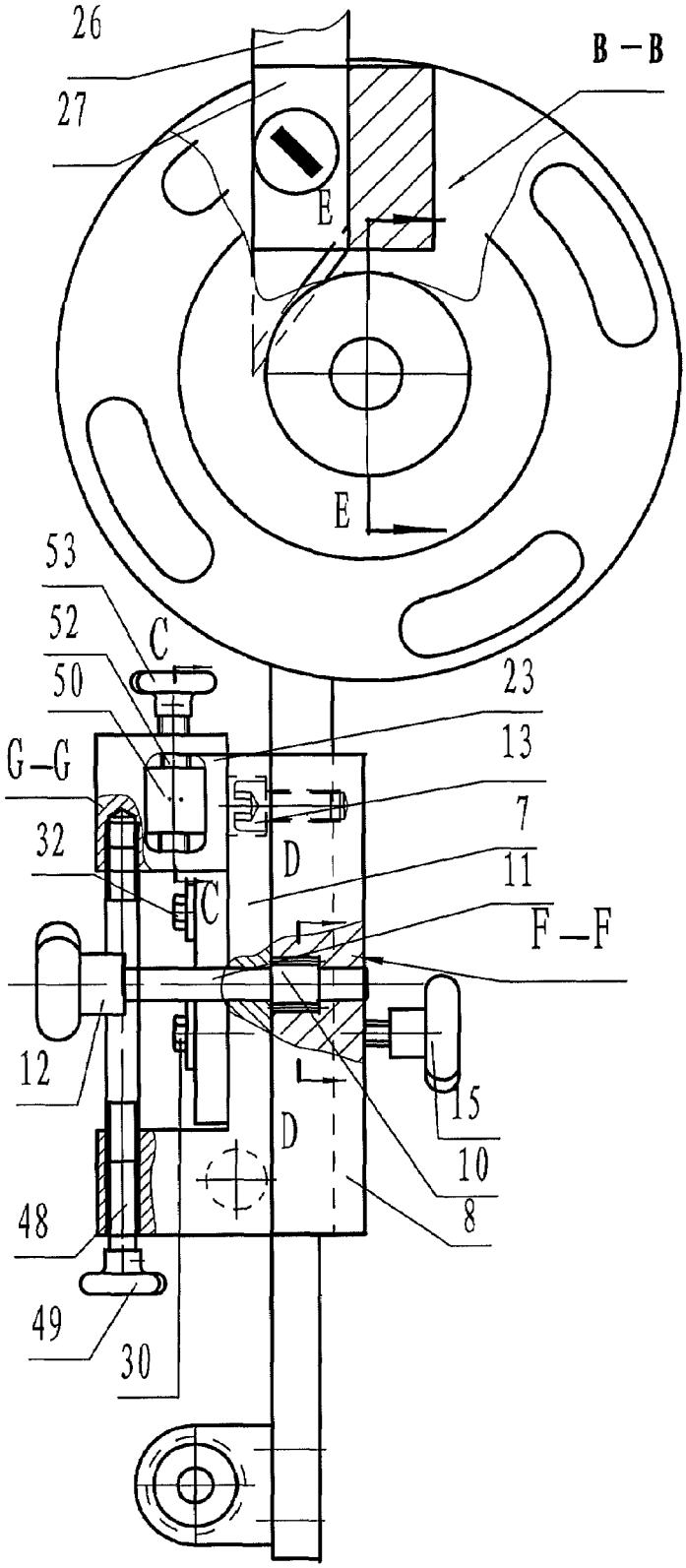
FIG. 8 is a right side view for the embodiment 3 of the present invention3 (including B-B, F-F and G-G sectional view of FIG. 7)
Figure 9:
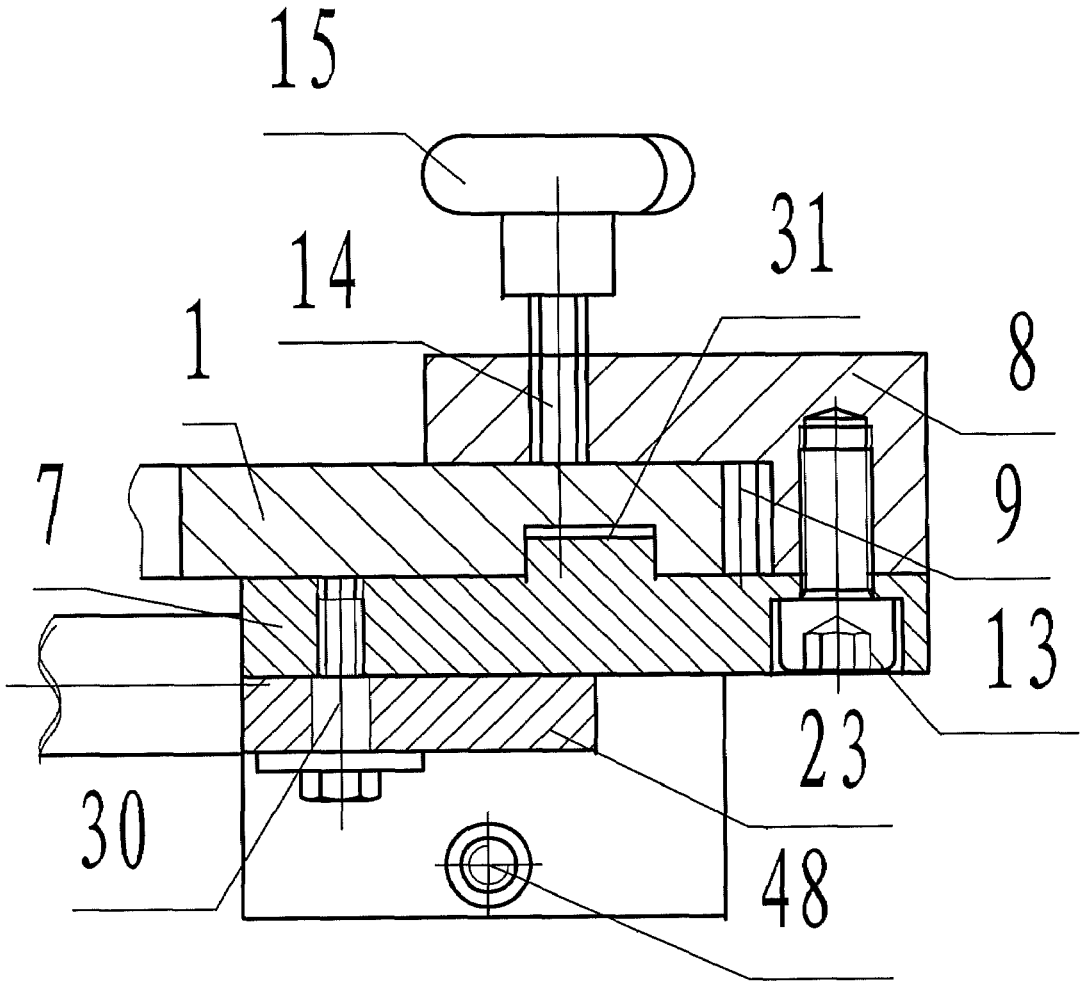
FIG. 9 is the A-A sectional view of FIG. 7.
Figure 10:
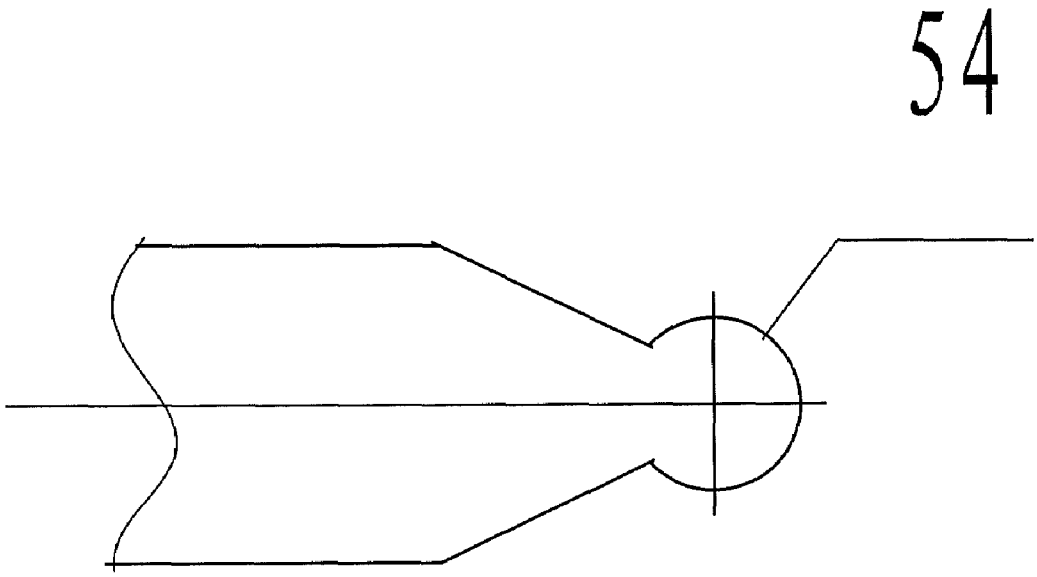
FIG. 10 is the principal view of the column top 51 in FIG. 7.
Figure 11:
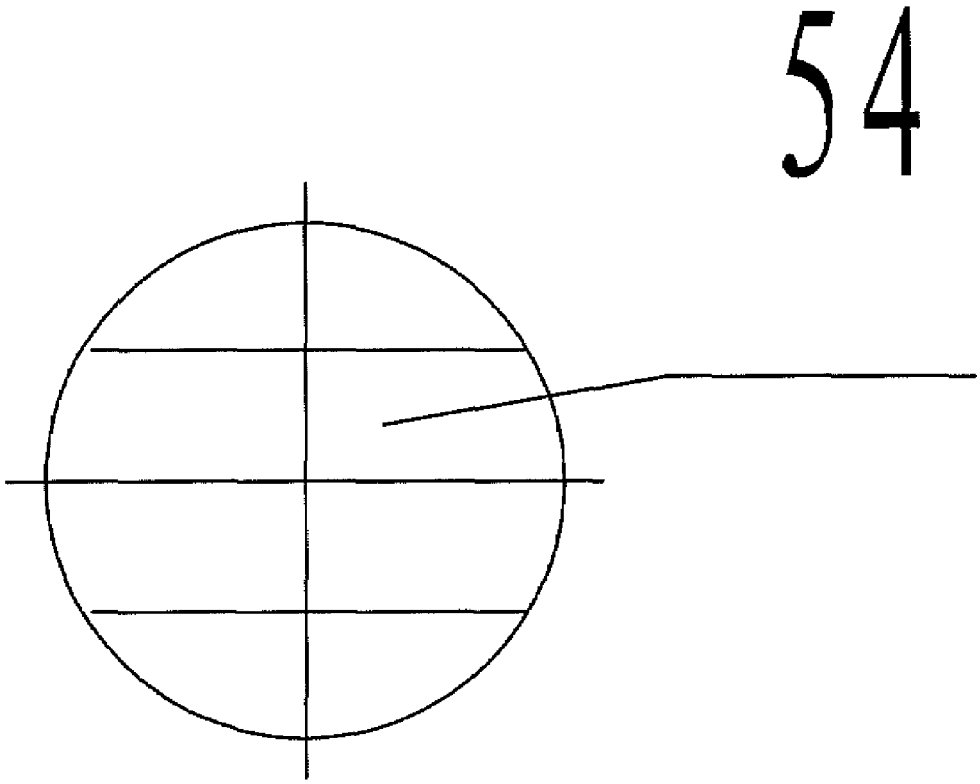
FIG. 11 is the right side view of the column top 51 in FIG. 7.
Figure 12:
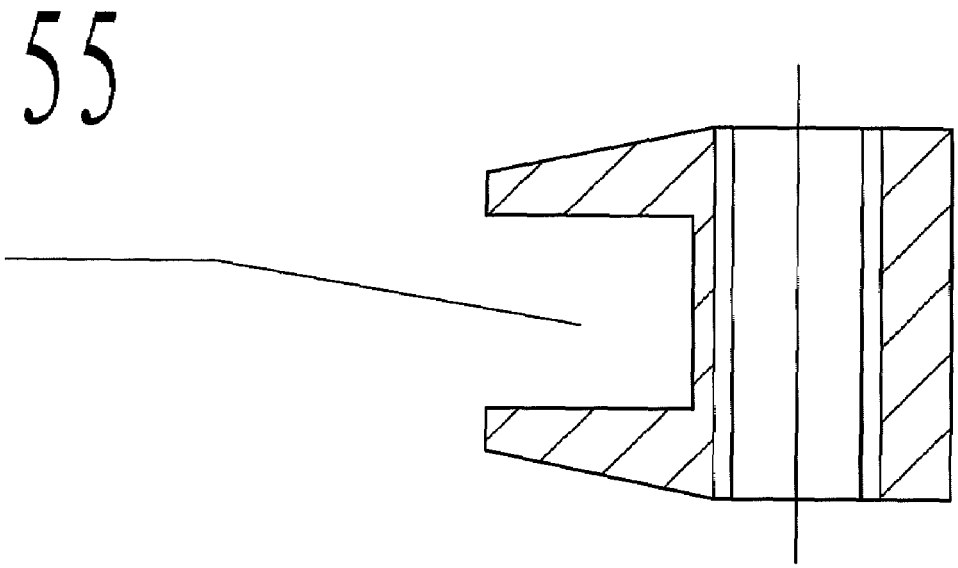
FIG. 12 is the principal view of the screw nut 50 in FIG. 7.

As shown in FIGS. 4 to 6, this embodiment is a soft roll material-translation device for a pillow type automatic packing machine, which comprises a frame 1, a left rotating device 2, a right rotating device 3, a left folding rod pair 4 and a right folding rod pair 5. The left rotating device 2 or right rotating device 3 comprises a rotating seat 7, a rotating guide unit and a rotating regulating unit. There is a pin roll 16 on the frame 1, and the rotating seat 7 of the left or right rotating device 2 or 3 is installed in the pin roll 16 through the corresponding axle hole. Moreover, the axis of the rotating center 6 of the left or right rotating device 2,3 is the axis of pin roll 16. The left folding rod pair 4 is attached to left rotating device 2, and the right folding rod pair 5 is positioned on the right rotating device 3. The left folding rod pair 4 or the right folding rod pair 5 is installed on the left or right rotating device2 or 3 of the rotating seat 7 separately. The left folding rod pair 4 comprises an upper folding arm 4*a* and a down folding arm 4*b*, and the right folding rod pair 5 comprises an upper folding arm 5*a* and a down folding arm 5*b*. The working portion of the upper folding arm 4*a*, down folding arm 4*b*, upper folding arm 5*a* and down folding arm 5*b* are all circular rods. The rotating guide unit comprises a pin roll 16 on the frame 1 and a axle hole on the rotating seat 7 of the left or right rotating device2 or 3. The rotating regulating unit comprises adjusting shaft 19, screw stem 20 and 21, and pin roll 22. The arc channel 17 is set on the frame 1, its centre matches the rotating center 6 together. The middle part of pin roll 18 is situated in the arc channel 17. One end of pin roll 18 is fasten on the rotating seat 7, and another end is connected with the screw stem 21. One end of pin roll 22 is fixed in the frame 1, and another end is connected with the screw stem 20. Both the two ends of the adjusting shaft 19 have the female thread with adverse rotary direction, and the screw stem 20 and 21 with the adverse rotary direction fits with the female thread in the two end of adjusting shaft 19. The down folding arm 4*b* or down folding arm 5*b* is mounted respective directly on the left or right rotating seat 7, and both the two down bus bars of 4*c* and 5*c* for the down folding arm 4*b* and 5*b* all pass through the rotating center 6. The upper folding arm 4*a* equipped with a swing regulating unit is positioned on the left rotating seat 7 connected through swing pin roll 24. The upper folding arm 5*a* is installed on the motional seat 23 which is mounted on the rotating seat 7. A motional guide unit and a motional regulating unit are equipped on the motional seat 23. The motional guide unit comprises a dovetail slide 43 which is on the motional seat 23 and a dovetail groove 44 which is on the rotating seat 7. The motional seat 23 is set on the rotating seat 7 by combined the dovetail slide 43 with the dovetail groove 44. The motional seat 23 may take the translational motion on the right rotating seat 7 through the combination of dovetail slide 43 and dovetail groove 44. The dovetail slide 43 and dovetail groove 44 is vertical to the axial of the down folding arm 5*b*. The motional regulating unit comprises a regulating shaft 45, screw 46 and 47. Both the two ends of the regulating shaft 45 have the female thread with adverse rotary direction, and the screws 46 and 47 with the adverse rotary direction cooperate with the female thread in the two end of regulating shaft 45 respectively. The screw 46 or 47 is mounted on the right rotating seat 7 or motional seat 23 respectively, and the axial of regulating shaft 45, screw 46 and 47 is vertical to the axial of the down folding arm 5*b*. The swing pin roll 24 of the upper folding arm 5*a* equipped with swing regulating unit is positioned on the motional seat 23. The swing regulating unit for the upper folding arm 4*a* or 5*a* comprises a screw stem 40, a rotational controller 41 and a screw nut 42. The screw stem 40 of the upper folding arm 4*a* is installed on the swing seat 7, its one end is furnished with rotational controller 41. The screw nut 42 of upper folding arm 4*a* is fitted into the slotted hole of upper folding arm 4*a*, and the screw nut 42 is cooperated with the screw stem 40. The screw stem 40 of the upper folding arm 5*a* is positioned on the motional seat 23, its one end is furnished with rotational controller 41. The screw nut 42 of upper folding arm 5*a* is fitted into its slotted hole, and is conjugated with the screw stem 40. A drive roll 25 and a tool carrier 27 are mounted on the frame 1, and a cutting knife 26 is located on the tool carrier 27. The drive roll 25 is situated in front of both the upper folding arm 4*a* and 5*a*. The cutting knife 26 stands in the middle of drive roll 25. A guide roll 28 is provided on the frame 1, and it is positioned at the backside of the down folding arm 4*b* and 5*b*.

Embodiment 3

With reference to FIGS. 7 to 12, this embodiment is a soft roll material-translation device for a pillow type automatic packing machine, which comprises a frame 1, a left rotating device 2, right rotating device 3, a left folding rod pair 7 and a right folding rod pair 5. Except for the location of the rotating slide guide 31, the structure of the motional regulating unit and the swing regulating unit, the other structure in the present embodiment is similar to that of in the embodiment, so it is not discussed in details. The rotating slide guide 31 is positioned on the interface of the frame 1 and the rotating seat 7. The motional regulating unit comprises a screw stem 48 and rotational controller 49 which is fixed to one end of screw stem 48. The screw stem 48 is equipped with two male threads which rotated in adverse direction, the two portion of female threads in adverse rotary direction is provided on the rotating seat 7 and the motional seat 23 respectively, and the male thread on screw stem 48 is cooperated with the corresponding female thread in the rotating seat 7 or motional seat 23 respectively. The swing regulating unit comprises a screw nut 50, a column top 51, a screw stem 52 and a rotary knob 53. The screw stem 52 is positioned on the motional seat 23, and the rotary knob 53 is installed at the end of rotary knob 53. The screw nut 50 matches with the screw stem 52. The column top 51 is positioned at the end of each upper folding arm 4*a* and 5*a*, a cylinder surface 54 is provided at the column top 51. There is a rectangle channel 55 on the screw nut 50 in which the column top 51 is inserted.

Figure 13:
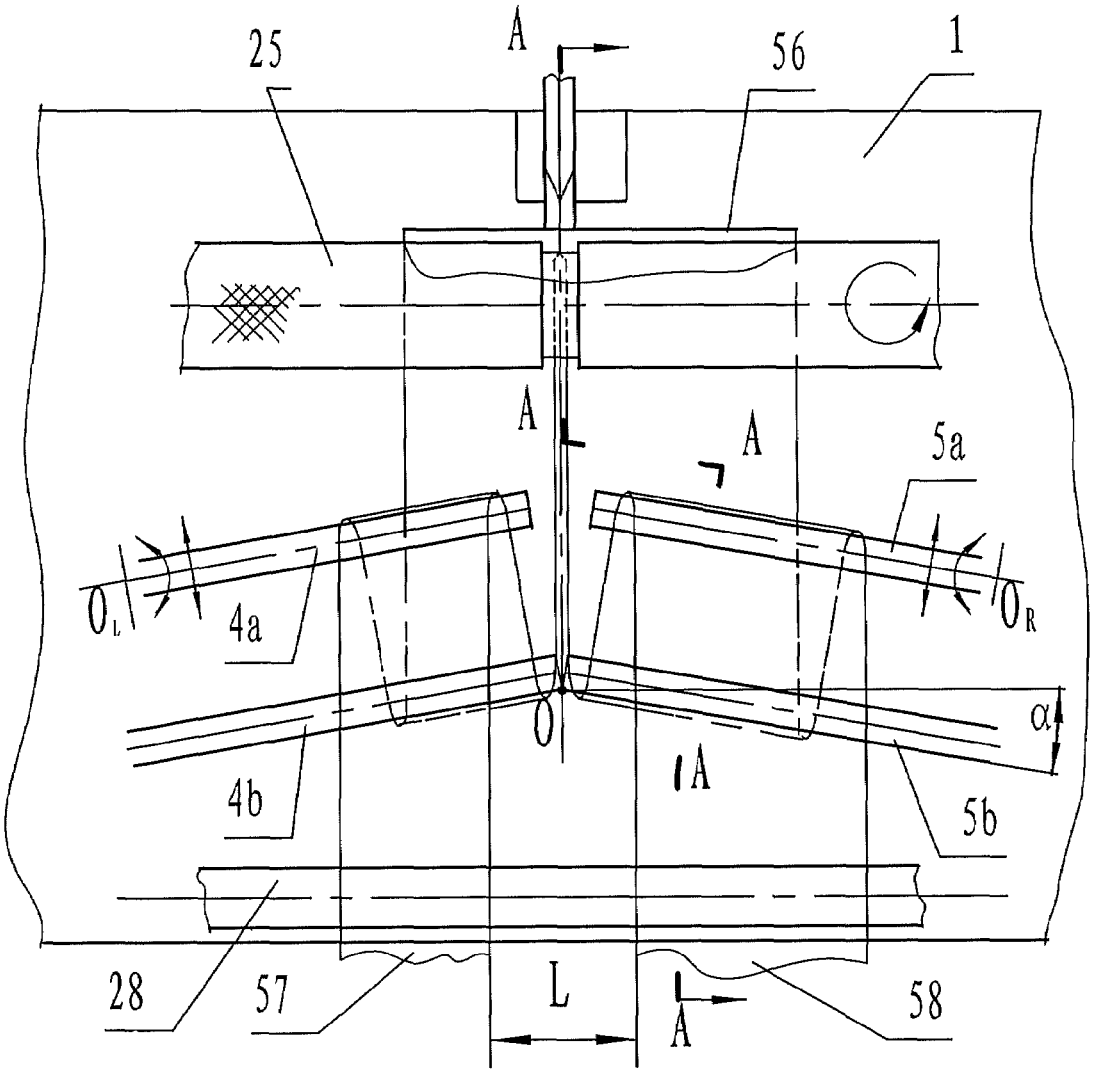
FIG. 13 is a schematic diagram for the principle of operation of the present invention.
Figure 14:
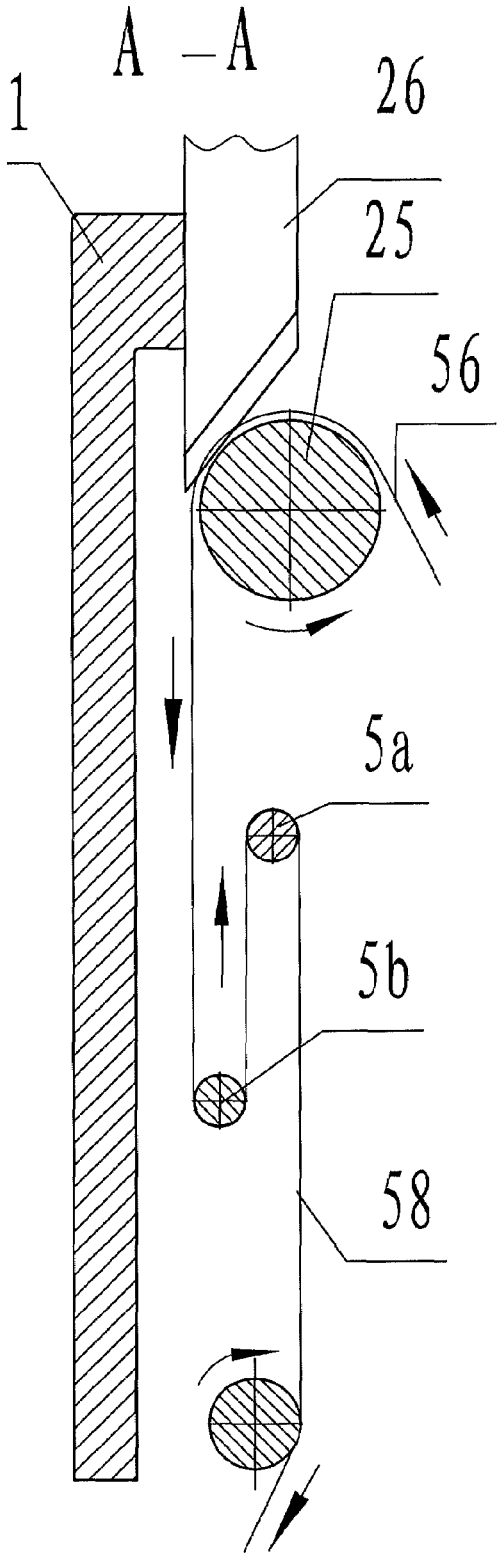
FIG. 14 is the A-A sectional view of FIG. 13.

The working principle of the three embodiments of the present invention is shown in FIGS. 13 to 14; a roll of plastic film 56 for pillow type automatic is cut into two parallel film strips 57 and 58 by the cutting knife 26 as the plastic film 56 passing through the drive roll 25. When the film strip 57 and 58 is folded and fed forward by passing the left folding rod pair 4 and right folding rod pair 5, the space L between the film strips 57 and 58 is enlarged but the film strip 57 and 58 is parallel with each other after traversing the folding rod pair. After passing through the guide roll 28, the packaging procedure using the film strip 57 and 58 of bag making and compact, vertical seal, across seal and cutting process, and so on are performed.

Two series of goods can be packaged at one time by using film strip 57 and 58 simultaneity. The space L between the film strip 57 and 58 is adjusted by changing the degree of angular $\alpha$ formed by frame 1 and upper folding arm 4*a* or lower folding arm 4*b*, as well as upper folding arm 5*a* or lower folding arm 5*b* by regulating the rotating regulating unit. By adjusting the space between the upper folding arm 4*a* and lower folding arm 4*b*, or the space between the upper folding arm 5*a* and folding arm 5*b* of the motional regulating unit, the error of length between film 57 and film strip 58 generated by the different elongation of drawn stretch during the procedure of downstream process can be controlled. The tension of each border of film strip 57 and film strip 58 is governed by adjusting the included angle formed by the upper folding arm 4*a* and lower folding arm 4*b*, or the included angle formed by the upper folding arm 5*a* and lower folding arm 5*b* of swing regulating unit.

I claim:

1. A soft roll material-translation device comprises a frame, wherein a left turning device and a right turning device that each one of them is turned on the axis of turning center are set apart on said frame; a left folding rod pair is installed on said left turning device, and a right folding rod pair is on said right turning device, said left folding rod pair comprises an upper folding arm and a down folding arm, and said right folding rod pair comprises an upper folding arm and a down folding arm, and the two folding arms of each folding rod pair are kept in parallel with one another, and an included angle for changing the space between the two strips of the soft roll material is formed by the left two folding arms and the right two folding arms along the direction of advance of the soft roll material.

2. The device of claim 1, wherein each of said left and right turning devices comprises a turning seat, a turning guide unit and a turning regulating unit, said left folding rod pair and said right folding rod pair are installed on the corresponding left and right turning device and of said turning seat separately.

3. The device of claim 2, wherein said turning guide unit comprises a slide block and a turning slide guide on said frame, said turning regulating unit comprising a sector gear and a gear; said turning slide guide being fixed on said gear sector, each of said sector gear of said left and right turning devices being fixed to the left and right sides of said frame separately, and their centers of the circle coincide with that of said turning center.

4. The device of claim 3, wherein said turning regulating unit further comprises a first screw stem and a knob; said first screw stem being cooperated with bolt hole in said slide block, and one end of said first screw stem contacting with said sector gear and another end being connected with said knob.

5. The device of claim 2, wherein said turning guide unit comprises a first pin roll on said frame and an axle hole on said turning seat of said left or right turning device; and said turning regulating unit comprises an adjusting shaft, a second screw stem and a third screw stem, and a second pin roll; an arc channel being set on said frame, its centre matching said turning center together; the middle part of a third pin roll being situated in said arc channel; one end of said third pin roll being fasten on said turning seat, and another end being connected with said third screw stem; one end of said second pin roll being fixed in said frame, and another end being connected with said second screw stem; both the two ends of said adjusting shaft having the female thread with adverse rotary direction, and said second and third screw stem with the adverse rotary direction fitting with the female thread in the two ends of said adjusting shaft.

6. The device of claim 2, wherein at least one of said first and second upper folding arms is installed on a motional seat which is mounted on said turning seat, and a motional guide unit and a motional regulating unit are equipped on said motional seat.

7. The device of claim 6, wherein said first or second upper folding arm is installed respectively on said motional seat through a corresponding swing pin roll, and both said first and second upper folding arms are equipped with swing regulating units.

8. The device of claim 7, wherein a drive roll and a tool carrier are placed on said frame, and a cutting knife is carried by said tool carrier; said drive roll standing in front of said first and second upper folding arms, and said cutting knife being situated in the middle of said drive roll.

9. The device of claim 8, wherein a guide roll is provided on said frame, and it is situated at the backside of said first and second down folding arms.

* * * * *